United States Patent [19]

van der Sanden

[11] Patent Number: 4,543,980

[45] Date of Patent: Oct. 1, 1985

[54] VALVE FOR PRESSURIZED CONTAINERS

[76] Inventor: John A. van der Sanden, 5 Beethovenlaan, Waalre, NL-5583XR, Netherlands

[21] Appl. No.: 643,307

[22] Filed: Aug. 22, 1984

Related U.S. Application Data

[63] Continuation-in-part of Ser. No. 523,563, Aug. 16, 1985, , which is a continuation-in-part of Ser. No. 445,230, Nov. 29, 1982, abandoned.

[30] Foreign Application Priority Data

Oct. 13, 1983 [DE] Fed. Rep. of Germany ..... 3337197

[51] Int. Cl.[4] ..... B65B 3/04

[52] U.S. Cl. ..... 137/315; 137/614.18; 137/614.2; 137/533.21; 137/512.1; 141/98; 215/18; 222/147

[58] Field of Search ..... 137/614.18, 614.2, 533.21, 137/512.1, 315, 320; 222/147; 141/98; 215/18

[56] References Cited

U.S. PATENT DOCUMENTS

| | | | |
|---|---|---|---|
| 2,979,067 | 4/1961 | Kern, Jr. et al. | 137/315 |
| 3,407,827 | 10/1968 | Follett | 251/65 |
| 3,589,397 | 6/1971 | Wagner | 137/614.2 |
| 3,704,813 | 12/1972 | Devol | 137/315 |
| 3,812,841 | 5/1974 | Isascson | 251/65 |
| 3,830,252 | 8/1974 | Follett | 251/65 |
| 3,985,332 | 10/1976 | Walker | 251/11 |
| 4,072,162 | 2/1978 | Bellehache et al. | 137/71 |
| 4,137,955 | 2/1979 | Carlson | 137/68 R |

FOREIGN PATENT DOCUMENTS

| | | | |
|---|---|---|---|
| 291105 | 9/1913 | Fed. Rep. of Germany | 215/18 |
| 439576 | 1/1912 | France | 215/18 |
| 641722 | 8/1950 | United Kingdom . | |

*Primary Examiner*—A. Michael Chambers

*Attorney, Agent, or Firm*—Sandler & Greenblum

[57] ABSTRACT

A valve for a pressurized container having a blocking element therein which is adapted to occupy an initial location in which fluid can move in and out of the container past the blocking element. The valve and blocking element are further configured such that the blocking element can be irreversibly moved to a position in which the valve permits escape of fluid under pressure exerted from the inside of the container, but which automatically closes in response to exposure to an external pressure greater than the pressure inside the container. The blocking element is formed of at least one flexible, radially extending arm whose lateral radius is reduced upon movement of the blocking element from the initial location to the final location. The at least one arm expands within the final location to prevent return of the blocking element to the initial location.

15 Claims, 12 Drawing Figures

VALVE FOR PRESSURIZED CONTAINERS

BACKGROUND OF THE INVENTION

1. Application Priority Status

This application is a continuation-in-part of application Ser. No. 523,563, filed Aug. 16, 1983, which is a continuation-in-part of application Ser. No. 445,230, filed Nov. 29, 1982, now abandoned, the disclosures of both of which are herein incorporated by reference.

2. Field of the Invention

The invention relates to valves for pressurized containers, e.g., pressurized gas bottles. The valve includes a valve housing mounted on the container, a valve body movable in the housing by means of a handle to allow and prevent release of fluid from the container. A nozzle is provided for venting fluid from the container.

The invention relates more particularly to pressurized containers which are commercially characterized as being "no-return" containers and which, for reasons of safety and otherwise, are not intended for re-use after their initial contents have been emptied.

3. Pertinent Materials and Background Information

As was noted in the previous parent applications, one commercial use of no-return containers is as pressurized gas bottles for cooling agents. Practice has shown that despite the labelling of these containers as "no-return" containers, repeated attempts are made to refill them through their nozzles. This practice is particularly dangerous when refilling is performed at excessively high pressures or when the container is filled with a different fluid than was originally intended and which is not compatible with either the bottle or valve.

The two parent applications have illustrated techniques in which one-way ball valves can be used in conjunction with pressurized containers so as to allow for them to be initially charged through an orifice, and wherein further charging is prevented once the initial charge has been completed. In the parent applications, this is performed by forcing a ball past a constriction into a final location in a manner such that it cannot return above the constriction. Once the ball is in this final location, it will block any further refilling by simply seating in the valve. However, the use of a ball valve is somewhat intricate and complex and requires careful precision machining.

U.S. Pat. No. 3,985,332 discloses a non-refillable safety valve for a pressure container. The valve includes a housing having a central bore, a hollow knob unit also having a central bore, and a core having a central bore which is slidably mounted in the central bore of the housing. The hollow knob unit is in threaded engagement with the outer wall of the housing. The central bore of the housing provides communication between a port and the pressurized container for charging and selective discharging of the pressurized container. A sealing member is provided which is slidably mounted in the lower end portion of the central bore of the core. An outwardly biased spring snaps outwardly into a channel to prevent the knob unit from being completely unscrewed. An element prevents the pressure vessel from being refilled. When the valve is in the position shown in FIGS. 2–4 or 6, refill cannot be accomplished because pressure on the end of central core 220 is greater than the pressure in vessel 100 and thus causes element 132 to seat in the seat in the sealing position. In the position shown in FIG. 1, i.e., before spring 216 has snapped into channel 220 as a result of the inward screwing of knob unit 176, element 132 is held away from the seat even if such a reverse pressure differential exists. In one embodiment shown in FIGS. 5 and 6, a groove 240 is provided in knob unit 176, and outwardly biased unit 216 fits in groove 240 and the adjacent groove formed by rings 208 and 212. In this embodiment, spring 216 prevents removal of knob unit 176; otherwise, operation of the valve system of FIGS. 5 and 6 is essentially the same as that of FIGS. 1–4.

Such a device is complex and expensive to manufacture. It is thus an object of the invention to provide a device which is simple in its construction, and which adds little to the cost of manufacturing a valve.

SUMMARY OF THE INVENTION

The objects of the invention are achieved by providing a valve for a pressurized container having a blocking element therein which is adapted to occupy an initial location in which fluid can move in and out of the container past the blocking element. The valve and blocking element are further configured such that the blocking element can be irreversibly moved to a position in which the valve permits escape of fluid under pressure exerted from the inside of the container, but which automatically closes in response to exposure to an external pressure greater than the pressure inside the container. The blocking element includes at least one flexible, radially extending arm whose lateral radius is reduced upon movement of the blocking element from the initial location to the final location. The at least one arm expands within the final location to prevent return of the blocking element to the initial location.

The valve itself is formed of a valve housing, and a stem to open and close the valve. The stem is configured to force the blocking element from the initial to the final location.

The valve housing comprises a constriction therein to compress the at least one arm as the blocking element moves from the initial to the final location. The constriction may be integral with the interior surface of the valve housing or, alternatively, it may be in the form of a ring secured within a groove on the interior surface of the valve housing. The valve may additionally comprise a second constriction on which the stem itself seats to close the valve. The blocking element may additionally comprise a shaft slidably positioned within the stem.

The at least one arm is configured to provide a fluid passage to permit fluid to flow around it when the blocking element is in the final location.

The blocking element may be formed of a shaft having an inverted cap formed with a plurality of the arms radically extending from one end thereof. Webbing which is fluid impermeable extends over only a portion of the length of the arms such that a plurality of fluid passages are formed around the out circumference of the cap.

According to yet another alternative, the blocking element may be in the form of a flat cap with the arms extending radially therefrom, in substantially a single plane. Again, the webbing extends over only a portion of the radial length of the arms.

Alternatively, the blocking element may have a flat bottom, with a plurality of the arms extending therefrom and ending in upstanding portions. The flat bottom is formed of the arms and webbing previously referred to.

In yet another embodiment, the blocking element has a flattened bottom which tapers into a plurality of upwardly extending arms. The flattened bottom is formed of the arms and webbing, as in the previously referenced embodiments.

As will be seen, in yet another embodiment, the blocking element is provided with a conical cap.

DESCRIPTION OF THE PREFERRED EMBODIMENTS

As was noted above, the valves of the invention find particular use in connection with pressurized containers. The annexed drawings do not illustrate the pressurized containers since they themselves do not form a part of the invention.

Figure 1:
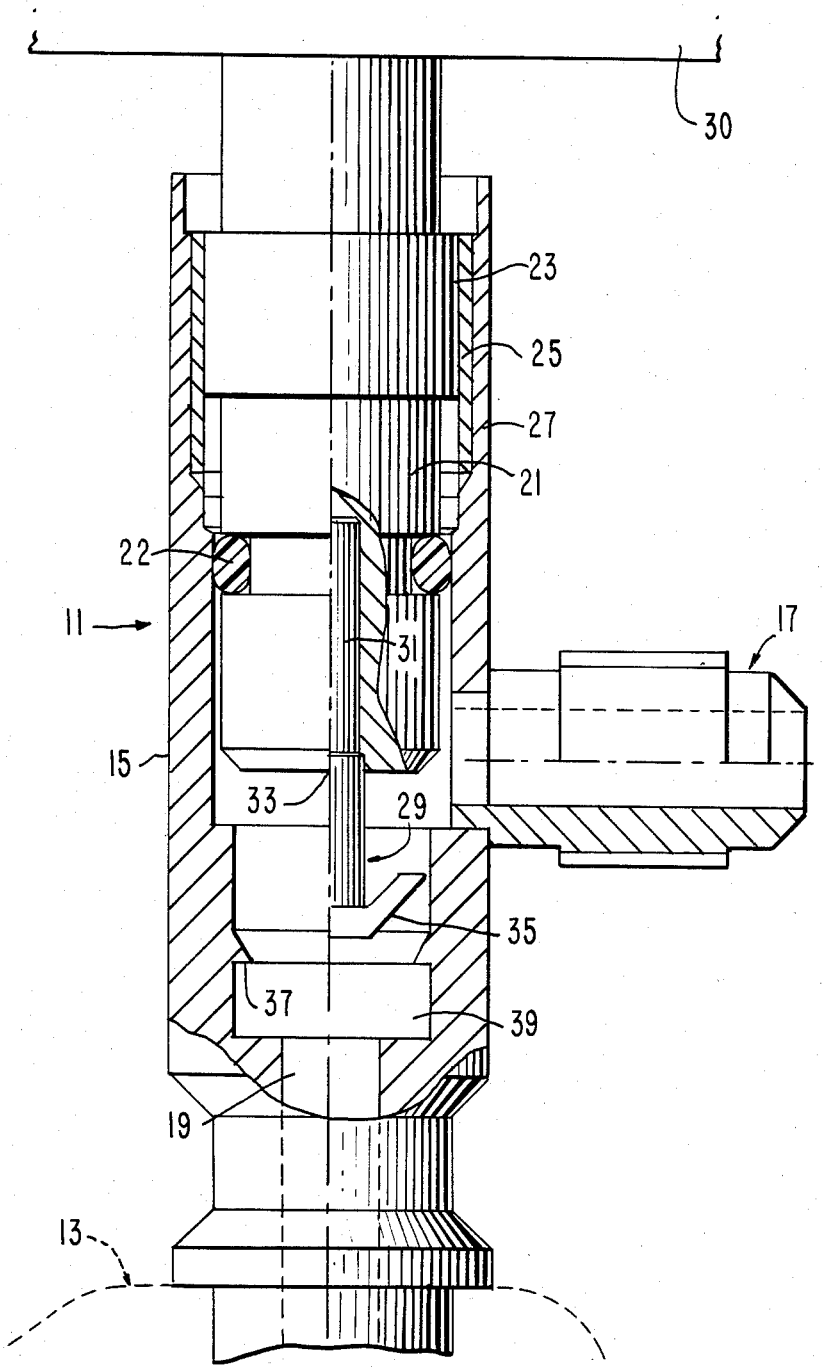
FIG. 1 illustrates a cross-sectional view of a first embodiment of the invention valve during initial charging.

FIG. 1 illustrates a first embodiment of the invention. In this embodiment, the valve is shown in an exploded and cross-sectional view. Valve 11 is mounted on container 13. Valve 11 is formed of a valve housing 15 and outlet nozzle 17. Gas leaving container 13 passes upwardly into valve 11 through passage 19 and ultimately out of nozzle 17. Conversely, the container may be initially charged under pressure through nozzle 17, through passage 19 into container 13. As shown in FIG. 1, valve 11 is provided with stem 21 having threaded portion 23 thereon. Threaded portion 23 is threadably associated with a threaded interior portion 27 of housing 15. Stem 21 is sealed within the housing by means of sealing ring 22 to prevent the upward escape of fluid.

Valve 11 further comprises a blocking element 29 having a shaft 31 axially fitted in a bore 33. Shaft 31 ends in an inverted mushroom-shaped, splayed, cap 35. The valve element may be made of any appropriate material, although the blocking element must itself have a skirt formed of at least one arm which is sufficiently resilient so as to be able to be forced past constricted portion 37 to its final location 39. By way of example only, the cap of the blocking element itself may be made of plastic or metal, provided that it has sufficient resiliency so as to function in the manner contemplated. The constricted portion serves to interiorly deflect the arms of cap portion 35 of the blocking element in a manner such that it passes into final location 39, where a certain clearance of movement is provided.

The valve, in the position shown in FIG. 1, is a two-way valve in that blocking element 29 cannot move down to constricted portion 37 when pressurized fluid such as a gas is injected into and through nozzle 17 into bottle 13 because it is held within the stem. Preferably, the shaft of the blocking element is held by being force fitted within the stem such that in the position shown in FIG. 1 it cannot move down so as to block any of the fluid being charged into the cylinder. During this charging, the blocking element remains essentially stationary, and openings between the arms forming the skirt provide fluid passages to facilitate charging. When charging is complete, stem 21 is lowered to the position shown in FIG. 2.

Figure 2:
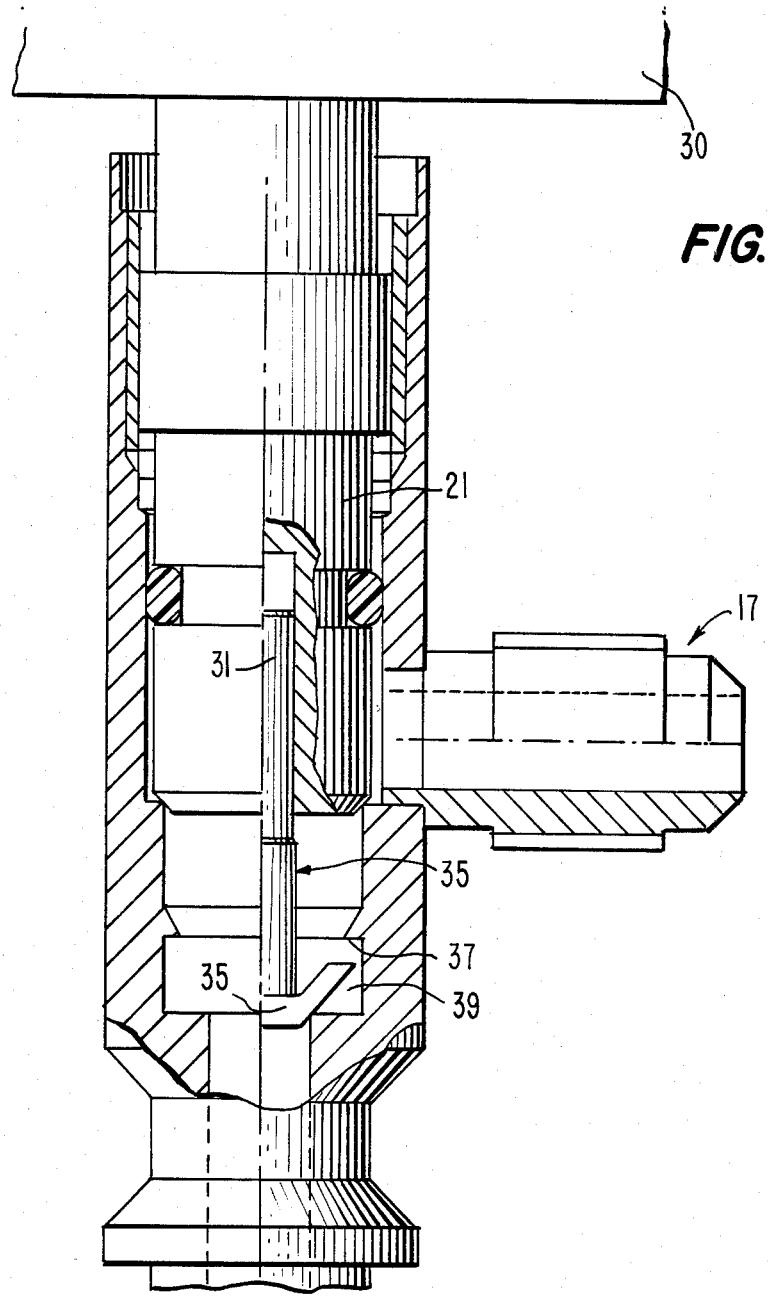
FIG. 2 illustrates a cross-sectional view of the inventive valve after initial charging has been completed and when the valve has been moved to the "no-refill" position.

As may be seen from FIG. 2, stem 31 normally blocks nozzle 17 such that fluid cannot escape from bottle 13 (not shown). As stem 21 is lowered into the position shown in FIG. 2, by screwing the stem with the assistance of handle 30, blocking element 35 is forced past constricted portion 37 into final location 39. The blocking element is elastic at its tip such that it can be forced past the constricted portion. When in final location 39, blocking element 35 can assume one of two extreme positions. When stem 21 is raised, the blocking element is prevented from rising as well, by virtue of its arms which cannot pass back through constricted portion 37, and pressurized gas leaves bottle 13, pushing blocking element 35 upwardly, to ultimately escape through nozzle 17. However, if, conversely, one attempts to lift stem 21 and refill bottle 13 through nozzle 17, the pressurized gas entering nozzle 17 will force blocking element 35 downwardly to the seated position shown in FIG. 2 to thereby prevent any further refill. Since shaft 31 is slidable within stem 21, any efforts to raise the stem will have no effect on the blocking element. Blocking element 35 prevents fluid flow in the position shown since a continuous impermeable webbing surface seats on the valve seat to prevent the escape of fluid.

Figure 10:
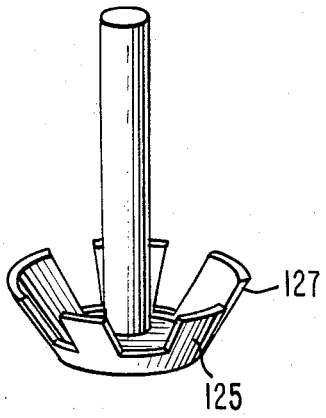
FIG. 10 illustrates a conical blocking element of the type shown in FIGS. 1 and 2 in perspective.

FIG. 10 illustrates a perspective view of the blocking element shown in FIGS. 1 and 2 which is conical, and has webbing 125 and arms 127.

Blocking element 35 can obviously assume a wide variety of configurations other than the inverted mushroom configuration shown in FIGS. 1 and 2. Although the embodiment shown in FIGS. 1 and 2 is preferred, a blocking element which can seat in the manner shown and which otherwise allows gas passage is all that is required. The material out of which the blocking element is made is not critical, although it must be sufficiently flexible so as to allow for compression of flexion during passage past the constricted portion, and then re-expansion when finally positioned in the final location. By way of example, certain plastics are preferred.

FIGS. 3–9 and 11 illustrate alternative embodiments of the invention.

Figure 3:
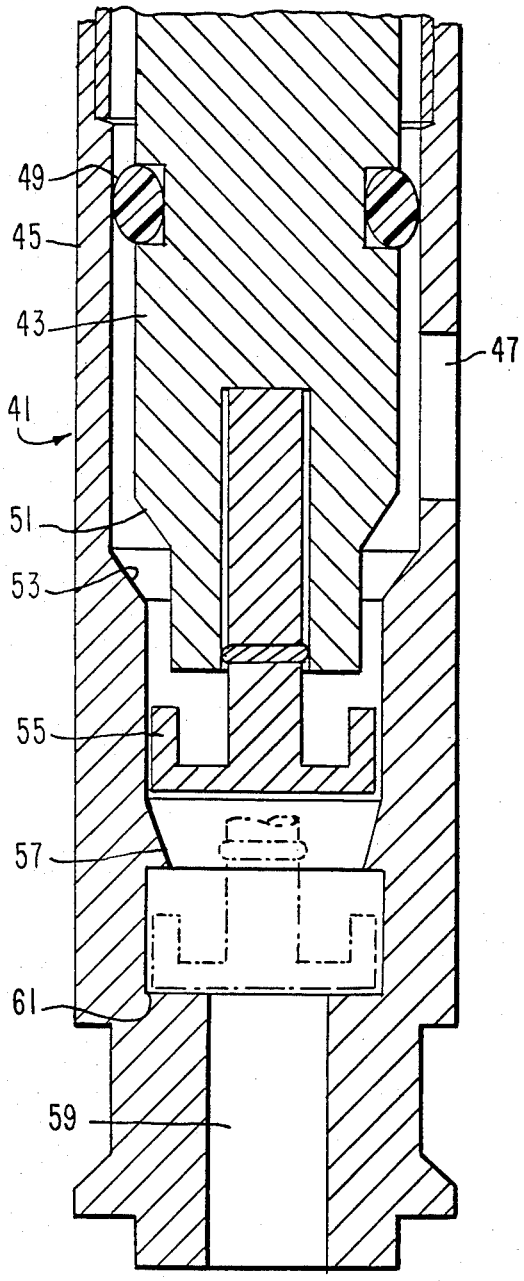
FIG. 3 illustrates a cross-sectional view of a valve having an alternative embodiment of a blocking element according to the invention.

In the embodiment shown in FIG. 3, valve 41 is shown with stem 43 slidable within valve housing 45. Valve housing 45 is provided with an opening 47 onto which a nozzle (not shown) is attached. Stem 43 is sealed within housing 45 by means of sealing ring 49.

The lower portion of stem 43 narrows into beveled portion 51, which is adapted to mate with constricted portion 53 of housing 45. In the position shown in FIG. 3, blocking element 55 is in an initial location during charging of the bottle or cannister 13. In this position, when gas enters through outlet 47, it passes downwardly past tapered portion 51, through blocking element 55, and downwardly into the bottle. However, after initial charging has occurred, stem 43 is depressed such that tapered portion 51 seats on constricted portion 53 and simultaneously forces blocking element 55 past a second constricted portion 57 into a location where it may assume a position such as that shown in dashed lines.

Figure 4:
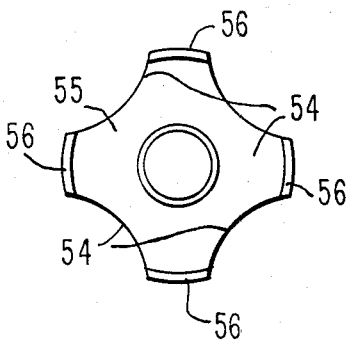
FIG. 4 illustrates the blocking element shown in FIG. 3 of the invention.

Blocking element 55 is shown in greater detail in FIG. 4. As may been seen from FIG. 4, the blocking element includes four arms 56, and four narrowed arcuate webbed portions 54 past which gas passes when blocking element 55 is in the raised position shown in FIG. 3 and when blocking element 55 is not seated in the position shown in dashed lines in FIG. 3. When blocking element 55 is seated, the arcuate portions are configured such that they do not extend inwardly further than the outer diameter of passageway 59 (shown in FIG. 3).

In this way, when blocking element 55 is lowered to its seated position, which will occur when an attempt is made to refill a container through outlet opening 47, blocking element 55 will seat on valve seat 61 and will prevent gas from entering passageway 59.

Figure 5:
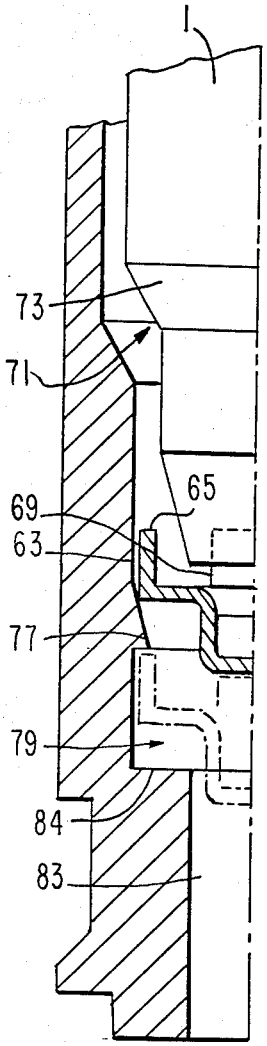
FIG. 5 illustrates a cross-sectional view of an alternative housing configuration and blocking element according to the invention.

FIG. 5 illustrates yet another embodiment of the invention in which a somewhat elliptical blocking element 63 is contemplated. As may be seen in FIGS. 5 and 6, the blocking element comprises an upright portion 65 at the end of each arm 67, which is coextensive with arm 67. Upright portion 65 is arcuate such that, as seen from above in FIG. 6, the blocking element is generally ellipsoid. The blocking element once again includes a shaft 69 extending into stem 71. Stem 71 once again has a tapered portion 73 which seats on a correspondingly configured portion 75 of the valve housing. When stem 71 seats on tapered annular portion 75, it forces blocking element 63 past constricted portion 77 into a final location 79, shown in dashed lines. When the stem has been pushed downwardly sufficiently to force the blocking element into final location 79, after the bottle has been initially charged, the valve may be used in its normal manner with the blocking element normally being pushed upwardly into the position shown in dashed lines by means of fluid pressure when the valve stem is released. However, blocking element cannot rise above constricted portion 77. In this position, gas is able to escape past blocking element 63 by virtue of the flattened portions on base 67. However, once again, when an attempt is made to refill the container, blocking element 63 will seat on seat 81 and entirely block passageway 83.

Figure 7:
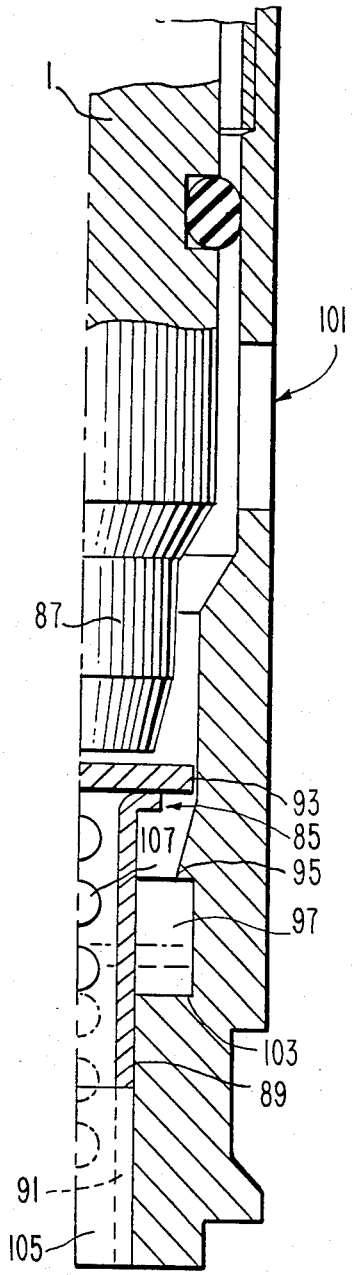
FIG. 7 illustrates a cross-sectional view of yet another embodiment of the valve according to the invention.
Figure 8:
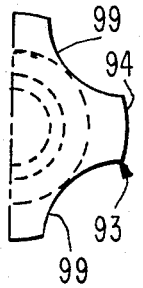
FIG. 8 illustrates a top view of the blocking element shown in FIG. 7.
Figure 6:
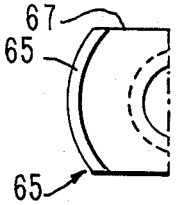
FIG. 6 illustrates a top view of a blocking element of the type illustrated in FIG. 5.

FIG. 7 illustrates yet another embodiment of the invention which again includes a valve, stem etc. as previously shown. In this instance however, blocking element 85 differs from those previously disclosed in that it does not have an element extending into stem 87 but rather is supported on a rod 89 slidably engaging the interior of passage 91. Blocking element 85 has a flattened element 93 which rests on rod 89 and when stem 87 is depressed after the initial fill, flattened element 93 is forced past constricted portion 95 into final location 97. In this location it will normally permit gas to flow upwardly and out through the outlet by virtue of the cut-outs 99 (see FIG. 8) which are provided. However, if an attempt is made to refill the bottle by injection of pressurized fluid through outlet 101, flattened element 93 will be forced against seat 103 and will prevent fluid from entering passage 105. Holes 107 are provided in rod 89 so as to allow fluid to flow into the container during the initial fill when the blocking element is in the raised position shown in solid lines. Likewise, when the blocking element is in the final location, beneath constriction 77, fluid escapes through holes 107 and is able to ultimately escape past cut-out portions 99 of flattened element 93. In this embodiment the blocking element is formed of four arms 94, separated by webbing.

Figure 9B:
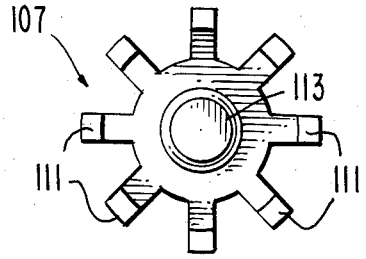
FIGS. 9A and 9B illustrate side and bottom views of another embodiment of the blocking element according to the invention.
Figure 9A:
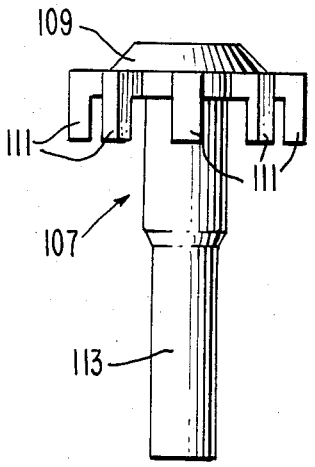

FIGS. 9A and 9B illustrate a slightly modified version of the blocking element shown in previous embodiments. In this embodiment, blocking element 107 does not end in a continuous taper, but rather has a webbing portion 109 which is inwardly radially offset from arms 111. It is arms 111 which are forced past the constriction within the valve by means of pressure exerted on shaft 113 as the stem is lowered to position the blocking element in its final location.

Figure 11:
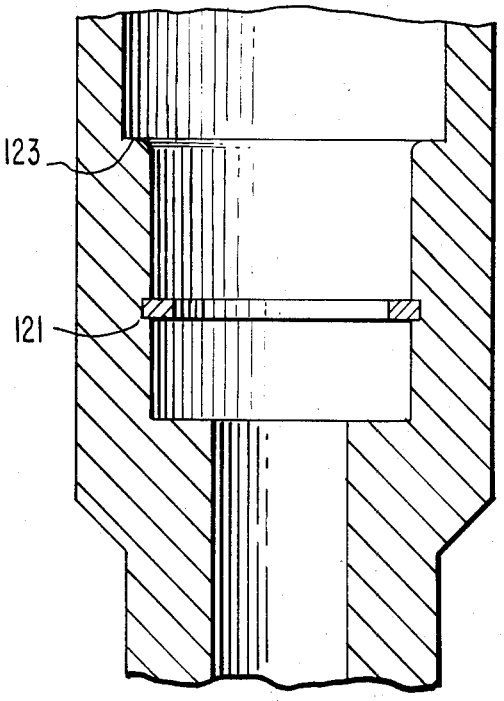
FIG. 11 illustrates a cross-sectional view of yet another embodiment of the valve according to the invention.

FIG. 11 illustrates yet another embodiment of the invention in which the interior of the housing is configured differently than in the previous embodiments. In this embodiment, instead of constricting the inner wall of the valve housing to maintain the blocking element in its final location, a split ring 121 is contemplated which fits within a cut-out in the interior surface of the valve housing. Once the blocking element (not shown) is forced past the split ring into the final location, it cannot be returned to its initial position, and re-filling of the container becomes impossible. As in previous embodiments, the valve has a constriction on which the stem seats so as to regulate the escape of fluid from the container.

Although the invention has been described with reference to particular means, materials and embodiments, it is to be understood that the invention is not limited to the particular disclosed and extends to all equivalents within the scope of the claims.

What is claimed is:

1. A valve for a pressurized container comprising a blocking element, said blocking element being adapted to occupy an initial location whereby fluid can move in and out of said container past said blocking element, said valve and blocking element being further configured such that said blocking element can be irreversibly moved to a final location in which said valve permits escape of fluid under pressure exerted from the inside of the container, but which automatically closes in response to exposure to an external pressure greater than the pressure inside the container, said blocking element comprising at least one flexible radially extending arm whose lateral radius is reduced upon movement of said blocking element from said initial location to said final location, and which at least one arm automatically expands within said final location to prevent return of said blocking element to said initial location.

2. The valve as defined by claim 1 wherein said valve comprises a valve housing and a stem to open and close said valve.

3. The valve as defined by claim 2 wherein said stem is configured to force said blocking element from said initial to said final location.

4. The valve as defined by claim 3 wherein said valve housing comprises a constriction therein to compress said at least one arm as said blocking element moves past said constriction from said initial to said final location.

5. The valve as defined by claim 4 wherein said constriction is integral with the interior surface of said valve housing.

6. The valve as defined by claim 4 wherein said constriction is a ring secured within a groove on the interior surface of said valve housing.

7. The valve element as defined by claim 1 wherein said at least one arm is configured to provide a fluid passage.

8. The valve as defined by claim 7 wherein said blocking element comprise a shaft having an inverted cap formed of a plurality of said arms at one end thereof, said cap further comprising fluid impermeable webbing between said arms extending radially outwardly from the center of said cap over less than the entire radial length of said arms whereby a plurality of said fluid passages are provided in the resulting openings betweens said arms.

9. The valve as defined by claim 8 wherein said inverted cap has a flat bottom, with said arms extending radially outwardly, and ending in upstanding portions.

10. The valve element as defined by claim 8 wherein said cap is flat and is formed of said arms and said webbing, with said arms extending radially therefrom in substantially the same plane.

11. The valve element as defined by claim 8 wherein said cap has a flattened bottom formed of said arms and said webbing, which cap tapers into said plurality of arms with no webbing therebetween.

12. The valve element as defined by claim 11 wherein said arms are upwardly extending.

13. The valve as defined by claim 8 wherein said cap is conical.

14. The valve element as defined by claim 1 wherein said valve comprises a stem to open and close said valve, said stem being configured to force said blocking element from said initial location to said final location, and wherein said valve housing comprises a first constriction therein to compress said arms as said blocking element moves from said initial to said final location, and a second constriction on which said stem seats to close said valve.

15. The valve as defined by claim 14 wherein said blocking element comprises a shaft slidably positioned within said stem.

* * * * *